US006167593B1

(12) United States Patent
Leifeld

(10) Patent No.: US 6,167,593 B1
(45) Date of Patent: Jan. 2, 2001

(54) APPARATUS FOR VARYING THE DEPTH OF A CHUTE IN A FIBER FEEDER

(75) Inventor: Ferdinand Leifeld, Kempen (DE)

(73) Assignee: Trützschler GmbH & Co. KG, Mönchengladbach (DE)

( * ) Notice: Under 35 U.S.C. 154(b), the term of this patent shall be extended for 0 days.

(21) Appl. No.: 09/392,448

(22) Filed: Sep. 9, 1999

Related U.S. Application Data

(63) Continuation-in-part of application No. 09/332,089, filed on Jun. 14, 1999.

(30) Foreign Application Priority Data

Jun. 12, 1998 (DE) ..... 198 26 071

(51) Int. Cl.[7] ..... D01B 1/00
(52) U.S. Cl. ..... 19/97.5; 19/105; 19/204
(58) Field of Search ..... 19/65 A, 65 R, 19/97.5, 98, 105, 200, 202, 203, 204, 205

(56) References Cited

U.S. PATENT DOCUMENTS

| | | | |
|---|---|---|---|
| 4,184,611 | 1/1980 | Binder et al. . | |
| 4,404,710 * | 9/1983 | Wood | 19/105 |
| 4,520,531 * | 6/1985 | Hergeth | 19/105 |
| 4,694,538 | 9/1987 | Pinto et al. . | |
| 4,734,957 * | 4/1988 | Lenzen | 19/105 |
| 4,939,815 * | 7/1990 | Leifeld | 19/105 |
| 5,611,116 * | 3/1997 | Leifeld | 19/105 |

FOREIGN PATENT DOCUMENTS

| | | |
|---|---|---|
| 688 197 | 6/1997 | (CH) . |
| 1118068 | 11/1961 | (DE) . |
| 33 15 909 | 11/1984 | (DE) . |
| 3413595 * | 10 1985 | (DE) . |
| 85 34 080 | 5/1987 | (DE) . |
| 40 36 014 | 5/1992 | (DE) . |
| 33 28 358 | 1/1993 | (DE) . |
| 42 25 656 | 2/1994 | (DE) . |
| 2 274 288 | 7/1994 | (GB) . |

* cited by examiner

*Primary Examiner*—John J. Calvert
*Assistant Examiner*—Gary L. Welch
(74) *Attorney, Agent, or Firm*—Venable; Gabor J. Keleman

(57) ABSTRACT

A fiber processing machine for forming a fiber lap from fiber tufts includes a generally vertically oriented reserve chute, a generally vertically oriented feed chute having an inlet adjoining the outlet of the reserve chute, and a fiber feeding assembly drawing fiber from the reserve chute and advancing fiber into the feed chute. The fiber feeding assembly includes a generally horizontally oriented feed roll having a rotary axis extending parallel to the horizontal width of the reserve chute, and a feed tray array cooperating with the feed roll and being composed of a series of individual feed trays lined up along the feed roll and rotatable about an axis. Each feed tray defines a nip with the feed roll. Measuring elements are coupled to each feed tray for emitting signals representing an extent of excursion of the respective feed tray as the fiber material passes through the respective nip. A control and regulating device is connected to the measuring elements for receiving the signals therefrom. Movable wall elements are arranged side-by-side parallel to the reserve chute width and form part of at least one of the reserve chute walls. Setting members are connected to the wall elements for moving the wall elements in sections in a direction parallel to the reserve chute depth for varying the size thereof.

10 Claims, 6 Drawing Sheets

APPARATUS FOR VARYING THE DEPTH OF A CHUTE IN A FIBER FEEDER

CROSS REFERENCE TO RELATED APPLICATION

This application is a continuation-in-part of pending U.S. application Ser. No. 09/332,089, filed Jun. 14, 1999.

This application claims the priority of German Application No. 198 26 071.7 filed Jun. 12, 1998, which is incorporated herein by reference.

BACKGROUND OF THE INVENTION

This invention relates to a fiber processing machine which forms a fiber lap (fiber batt), for example, from wool or chemical fiber tufts. The machine includes a fiber feeding device composed of a slowly rotating feed roll cooperating with a feed tray array. A rapidly rotating opening roll is disposed immediately downstream of the feed roll (as viewed in the direction of fiber advance). The fiber feeding device and the opening roll withdraw the fiber material from an upper chute (reserve chute) and forward the material to a lower chute (feed chute). The feed tray is formed of a plurality of individual feed trays rotatable about an axis, and each feed tray is associated with a respective measuring member which emits signals representing the density (thickness) of the running fiber material and which is coupled to a control and regulating device that operates setting members.

In a known device of the above-outlined type as disclosed, for example, in German Offenlegungsschrift (application published without examination) 34 13 595, in a fiber tuft feeder for a card, above the opening roll which separates the upper chute (reserve chute) from the lower chute (feed chute), a feed roll is disposed which draws the fiber tufts from the upper chute in cooperation with a feed tray array composed of a plurality of closely side-by-side arranged individual feed trays. Each feed tray is pivotal about an axis which extends parallel to the feed roll axis. The individual feed trays are pivoted by the fiber tufts to an extent which depends from the mass of the fiber tufts passing through the gap defined by the feed trays and the feed roll.

Each individual feed tray is coupled with an electromagnet which, in turn, is connected with a control device. The feed trays also serve as sensors which control the control device. The air pervious wall of the reserve chute is covered by a series of sliders which are individually vertically movable by means of electromagnets coupled to the control device.

It is a disadvantage of the above described prior art arrangement that as the air passage openings are enlarged or reduced by the vertically movable sliders, the flow rate of the transporting and densifying air stream for the fiber tufts fluctuates. It is a further disadvantage that because of such a fluctuation, an undesired delay of the regulation of the fiber lap occurs, particularly as concerns the compensation of the thickness fluctuations. In the known device, in the region of the narrow lateral walls of the feed chute the height of the fiber tuft column in the chute drops. Since the height of the sides of the fiber tuft column in the chute—as viewed along the width of the feeder—is not uniform, such devices cannot be used in wide roller card feeders having a width of 3 m and more.

SUMMARY OF THE INVENTION

It is an object of the invention to provide an improved device of the above-outlined type from which the discussed disadvantages are eliminated and which, in particular, ensures an improved uniformity of the fiber lap and further ensures an equalization of the height of the fiber tuft column in the feed chute.

This object and others to become apparent as the specification progresses, are accomplished by the invention, according to which, briefly stated, the fiber processing machine for forming a fiber lap from fiber tufts includes a generally vertically oriented reserve chute, a generally vertically oriented feed chute having an inlet adjoining the outlet of the reserve chute, and a fiber feeding assembly drawing fiber from the reserve chute and advancing fiber into the feed chute. The fiber feeding assembly includes a generally horizontally oriented feed roll having a rotary axis extending parallel to the horizontal width of the reserve chute, and a feed tray array cooperating with the feed roll and being composed of a series of individual feed trays lined up along the feed roll and rotatable about an axis. Each feed tray defines a nip with the feed roll. Measuring elements are coupled to each feed tray for emitting signals representing an extent of excursion of the respective feed tray as the fiber material passes through the respective nip. A control and regulating device is connected to the measuring elements for receiving the signals therefrom. Movable wall elements are arranged side-by-side parallel to the reserve chute width and form part of at least one of the reserve chute walls. Setting members are connected to the wall elements for moving the wall elements in sections in a direction parallel to the reserve chute depth for varying the size thereof.

The inventive setting of the wall elements in a direction parallel to the chute depth makes possible a more intense infeed of the fiber material at locations of reduced height, that is, in the zones immediately adjacent the two side walls and further makes possible a reduced infeed at locations of greater height, so that, as a result, the height of the fiber tuft column in the reserve chute over its width is equalized and thus the production of a more uniform fiber lap is ensured.

By virtue of the fact that the measuring members which are associated with the individual feed trays and which emit signals representing the fiber material density (thickness) in the vicinity of the movable wall elements and that both are situated in the region where the fiber lap is being formed, a rapid (short period) regulation of the fiber lap is possible.

The invention has the following additional advantageous features:

The length of the wall elements is identical to the length of the individual feed trays, wherein the lengths are viewed parallel to the feed roll axis.

The wall elements extend essentially throughout the height of at least one of the chute side walls.

The wall elements surround the chute zone where the fiber lap is being formed.

The wall elements are pivotally supported wall segments of the reserve chute.

Each wall element is moved by a separate pneumatic setting element such as a pneumatic cylinder.

Air outlet openings are provided in the region of the lap forming zone.

The adjustable wall elements, the individual feed trays and the feed roll are situated at the lower end of the reserve chute.

At the lower end of the lower chute (feed chute) a feed roll and cooperating feed tray and wall elements are provided which are adjustable in sections parallel to the chute depth.

Each wall element is pivotal in cantilever fashion about its own pivotal (rotary) support.

The wall elements are outwardly swingable.

The rotary supports are mounted on one of the chute walls.

With each individual feed tray a measuring member is associated for determining the thickness of the fiber material and the respective measuring members are connected, via the control and regulating device, with the setting elements for the wall elements.

The flow rate of fiber supplied to the upper (reserve) chute is varied as a function of the deviation of an actual value from a desired value.

DESCRIPTION OF THE PREFERRED EMBODIMENTS

Figure 1:
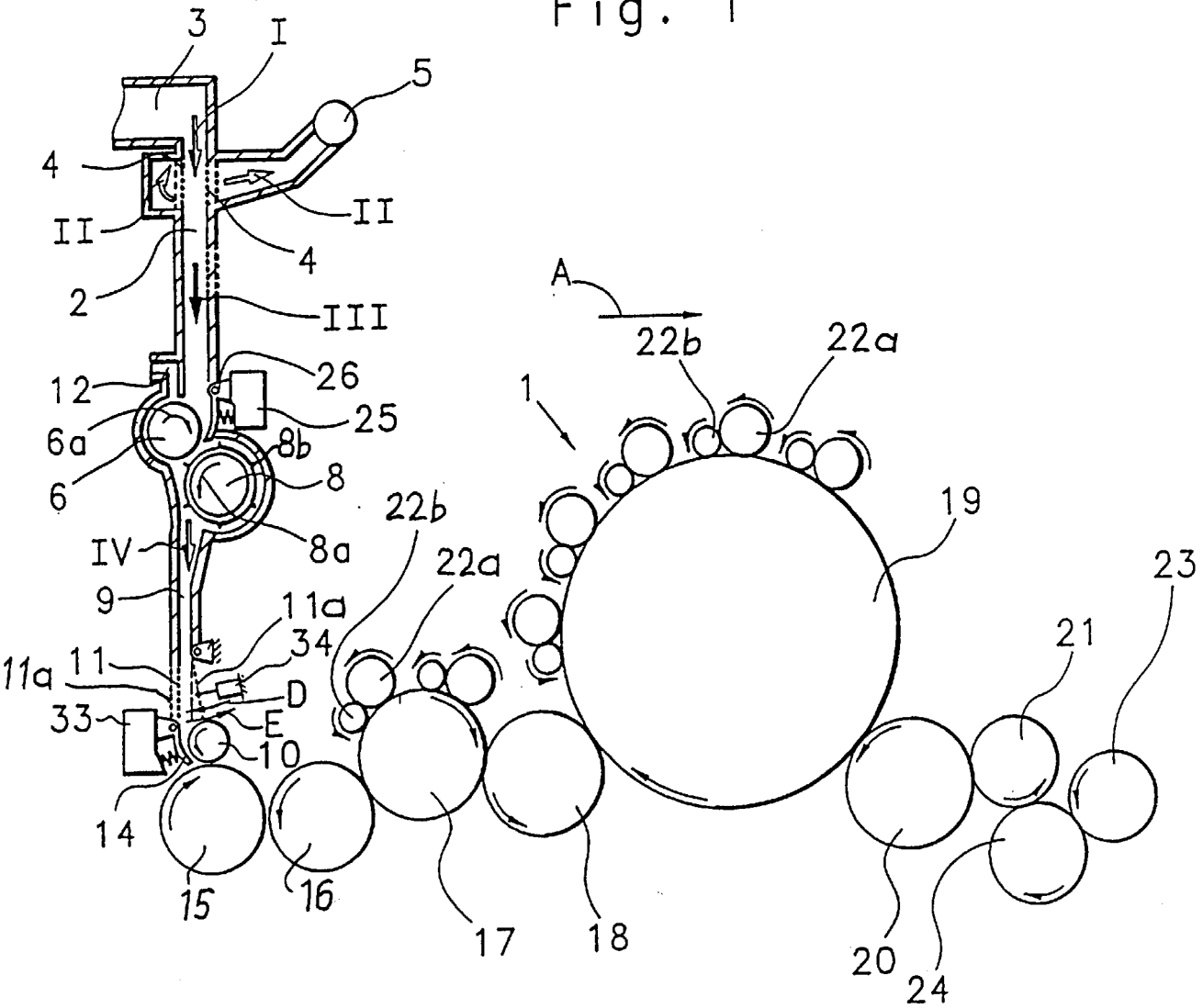
FIG. 1 is a schematic side elevational view of a machine assembly formed of a roller card and a roller card feeder incorporating the invention.

Turning to FIG. 1, upstream of a roller card unit 1 a fiber feeder is located, having a vertically oriented reserve chute 2 charged from above with a mixture I of air and finely opened fiber material (fiber tufts). Such charging may be effected, for example, by a condenser or by a supply and distributor duct 3. In the upper region of the reserve chute 2 air outlet openings 4 are provided through which the transporting air II leaves the reserve chute after being separated from the fiber tufts III by means of a suction device 5. The lower end of the reserve chute 2 is closed off by a feed roll 6 which has a rotary axis 6' and which cooperates with a feed tray array 7 formed of a plurality of individual feed trays 7*a* as shown in FIG. 4*b*. The fiber material III is advanced from the reserve chute 2 by means of the feed roll 6 which rotates slowly in the direction of the arrow 6*a* to a rapidly rotating opening roll 8 having pins 8*b* or a sawtooth clothing on its circumferential surface. One part of the circumference of the opening roll 8 faces a lower feed chute 9. The opening roll 8 which rotates in the direction of the arrow 8*a* advances the fiber material III into the lower chute (feed chute) 9. The feed chute 9 has at its lower end a withdrawing roll 10 which advances the fiber material to the roller card unit 1. The fiber feeder may be an EXACTAFEED model, manufactured by Trützschler GmbH & Co. KG, Mönchengladbach, Germany. The feed roll 6 rotates slowly clockwise and the opening roll 8 rotates rapidly counterclockwise.

Figure 3:
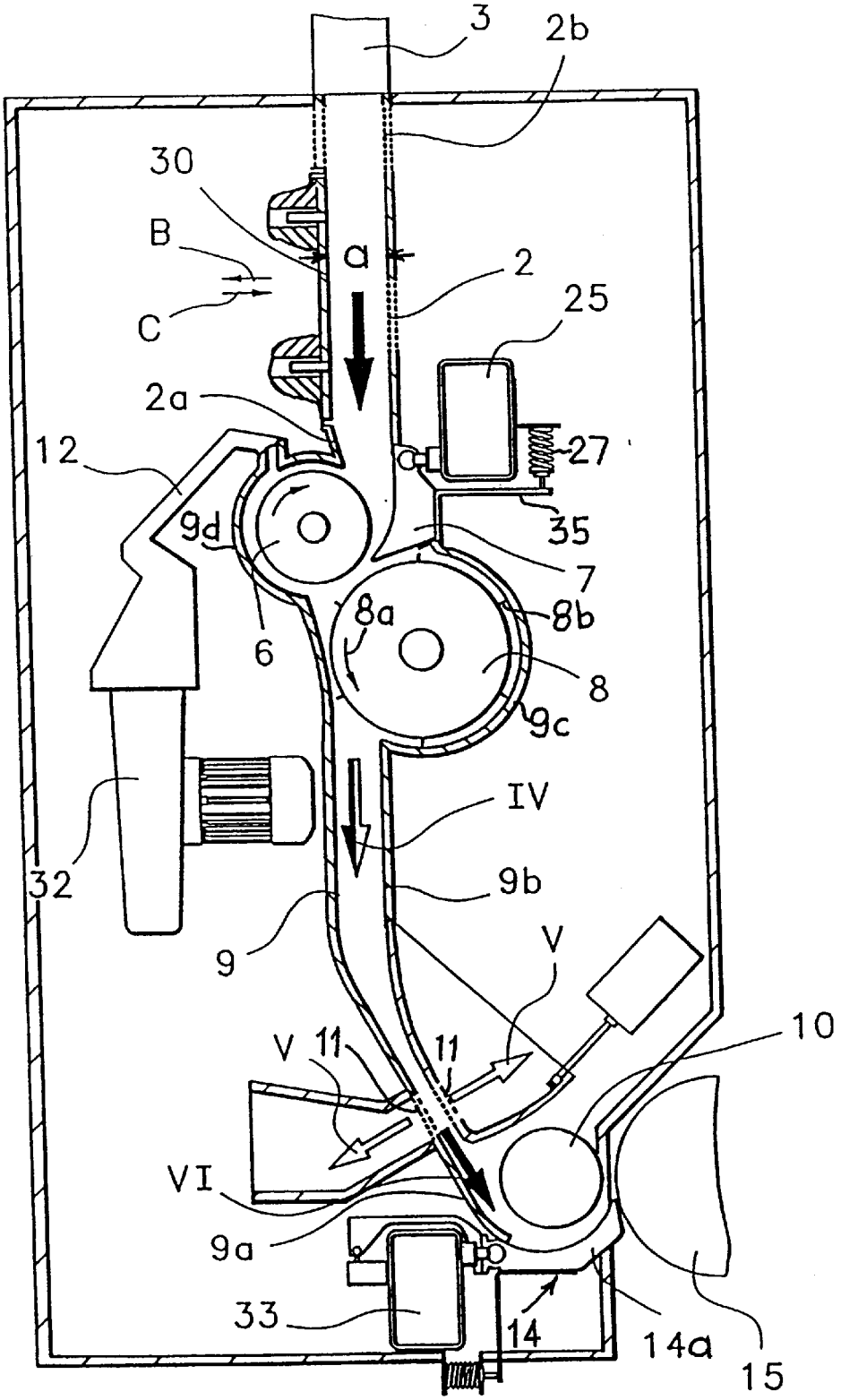
FIG. 3 is a sectional side elevational view of the roller card feeder of FIG. 1, shown on an enlarged scale and illustrating additional details.

Also referring to FIG. 3, the lower part of the walls of the feed chute 9 are provided with air outlet openings 11 to separate the air stream V from the fiber stream VI. At the top, above the feed roll 6, the feed chute 9 is in communication with a duct 12 coupled to the output of a blower 32. The rotating feed roll 6 and the opening roll 8 continuously advance the mixture IV of air and fiber material at a certain flow rate into the feed chute 9 and an identical quantity of fiber VI is drawn from the feed chute 9 by the withdrawing roll 10 which cooperates with a feed tray array 14 composed of a plurality of individual feed trays 14*a* (only one is visible) and which advances the fiber material from the feed chute 9 to the roller card unit 1. The blower 32 drives an air stream from the duct 12 onto the fiber material in the feed chute 9 for ensuring a uniform densification of the fiber material and for maintaining constant the flow rate thereof. The opening roll 8 and the feed roll 6 are surrounded by respective parts 9*c* and 9*d* of the chute 9. The chute parts 9*c* and 9*d* conform to the circumference of the rolls 6 and 8. As viewed in the direction of rotation 8*a* of the opening roll 8, the chute part 9*c* is interrupted by a separating opening for the fiber material. The separating opening is adjoined by the wall region which extends to the feed roll 6.

Figure 2:
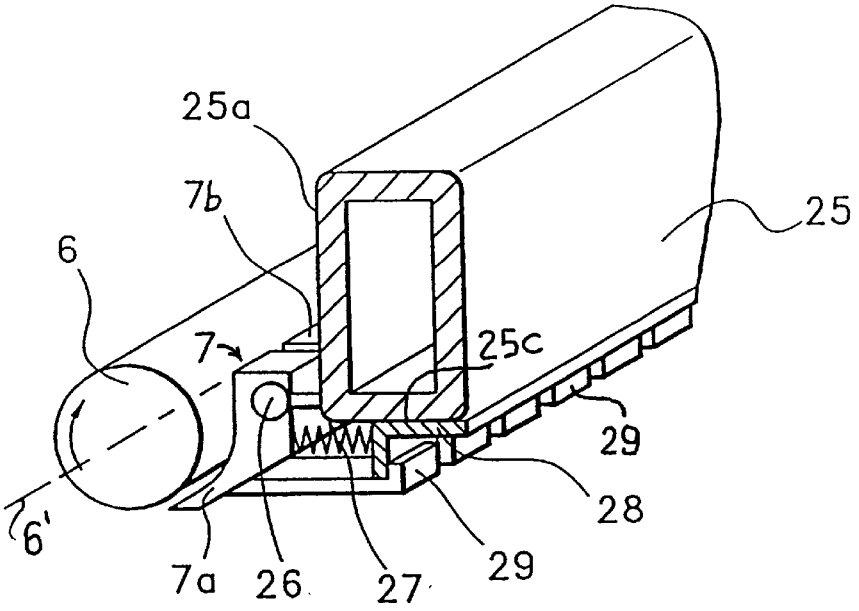
FIG. 2 is a fragmentary perspective view of a feed roll as well as individual feed trays mounted on a carrier element according to the invention.

Also referring to FIG. 2, at the lower end of the wall zone facing the feed roll 6 a feed tray (intake tray) array 7 is arranged. The edge of the feed (intake) tray array 7 is oriented in the rotary direction 8*a* of the opening roll 8. The plane which contains the rotary axes of the feed roll 6 and the opening roll 8 is oriented at an oblique angle to the vertical plane which contains the rotary axis of the opening roll 8. As viewed above the axis of the opening roll 8, the oblique plane is offset relative to the vertical plane in the direction of rotation 8*a* of the opening roll 8. The reserve chute (upper chute) 2 includes wall elements 30 which are displaceable in the direction of the chute depth as illustrated in FIG. 4*c*. The wall portions 11*a* of the feed chute 9 which contain the air outlet openings 11 are formed in sections and are supported on the side wall 9*b* for rotation in the direction of the arrows D and E. Each section 11*a* is associated with a setting device 34, such as a pneumatic cylinder. This arrangement allows a sectionwise adjustment of the depth of the feed chute 9 in the region where the fiber lap (fiber batt) is formed.

The feeding device for the roller card unit 1 is constituted by the withdrawing roll 10 and the feed tray array 14 at the lower end of the feed chute 9. Downstream of the feed roll 10 and the feed tray array 14, as viewed in the direction of fiber advance A in the roller card unit 1, there are provided a first preliminary roll 15, a second preliminary roll 16, a licker-in 17, a transfer roll 18, a main cylinder 19, a doffer 20 and a stripping roll 21. With the licker-in 17 and the main cylinder 19 two and, respectively, six roll pairs are associated, each formed of a working roll 22*a* and a reversing roll 22*b*. Two calender rolls 23 and 24 are disposed immediately downstream of the stripping roll 21 to cooperate therewith. The rotation of the individual rolls is indicated by the curved arrows drawn therein.

As shown in FIG. 2, a carrier beam (carrier element) 25 is provided which is made, for example, of structural steel and which has a hollow, rectangular cross-sectional configuration. The carrier beam 25 is stable and resists bending. It has a length of, for example, 5 m or more and extends parallel to and throughout the width of the machine. A plurality of individual feed trays 7*a* are secured by means of respective rotary supports 26 to a side wall 25*a* of the carrier beam 25 between the carrier beam 25 and the feed roll 6. Each feed tray 7*a* is supported by a respective compression spring 27 on a throughgoing angle member 28 which is secured to the bottom wall 25*c* of the carrier beam 25. Further, abutment elements 29 are provided which limit the excursion of the respective feed trays 7*a*.

Turning to FIGS. 3 and 4*c*, the side wall 2*a* of the upper reserve chute 2 has a plurality of wall elements 30 which are displaceable in the direction of the arrows B, C whereby the depth a of the reserve chute 2 may be zonewise adjusted. Each wall element 30 is movable by its own setting device, such as a pneumatic power cylinder 31 coupled to an electronic control and regulating device (such as a microcomputer) 38. The height of the wall elements 30 essentially corresponds to the region where the fiber lap is formed from the fiber tufts. As shown in FIGS. 1 and 3, the carrier beam 25, together with the rotatable feed trays 7*a*, is arranged at the lower end of the wall 2*b* of the reserve chute (upper chute) 2. At the lower end of the wall 9*a* of the feed chute 9 a further carrier beam 33 is arranged which, similarly to the carrier beam 25, may be made of structural steel. The carrier beam 33 rotatably supports feed trays 14*a* which form a feed tray array 14. A fan 32 introduces air into the region of the feed roll 6 through the duct 12.

FIG. 4*b* shows that the carrier beam 25 which has a length of approximately 5 m, is disposed in the region of the lower end of the chute side wall 2*b* and extends throughout the width b of the machine and is held in side plates 39*a*, 39*b* of the machine frame by supporting components 25' mounted on the side plates 39*a*, 39*b* and being adjustable relative thereto. The carrier beam 25 rotatably supports five individual feed trays 7*a* each being 1 m wide and made of an extruded aluminum member having a wear-resistant surface exposed to the fibers. The feed trays 7*a* are rotatable in the direction of the arrows F, G by virtue of the rotary supports 26 affixed to the side wall 25*a* of the carrier beam 25.

Figure 4A:
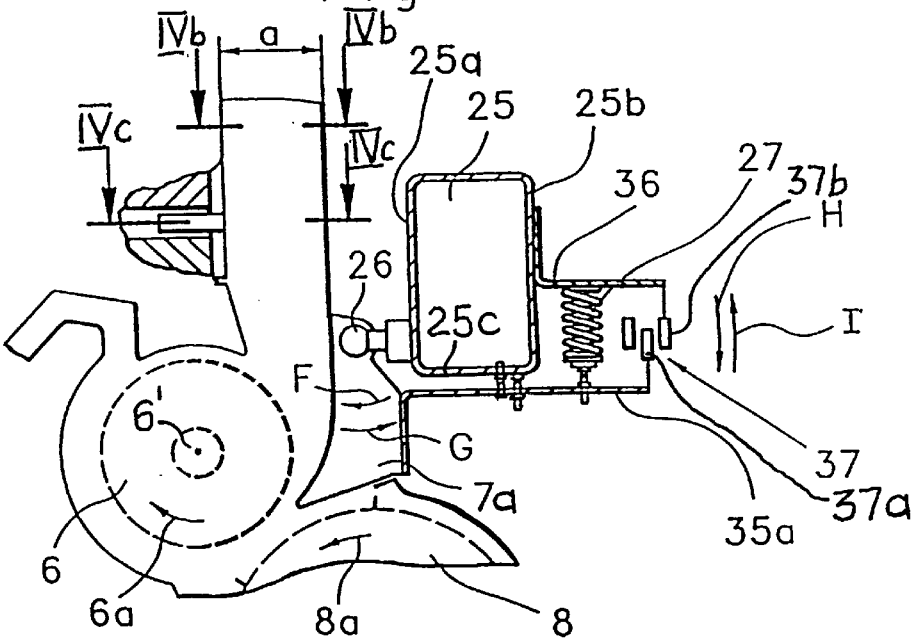
FIG. 4*a* is a sectional side elevational view of a variant of the construction shown in FIG. 2, wherein the fiber feeding assembly according to the invention is located at the lower part of the reserve chute.
Figure 4B:
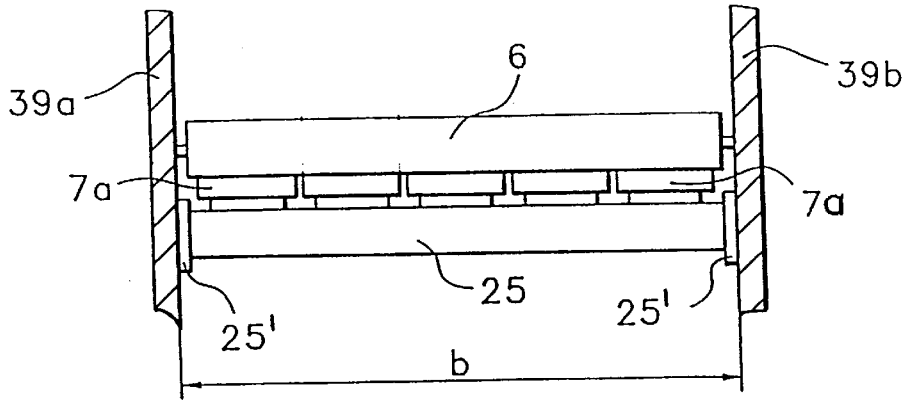
FIG. 4*b* is a sectional view taken along line IVb—IVb of FIG. 4*a*.
Figure 4C:
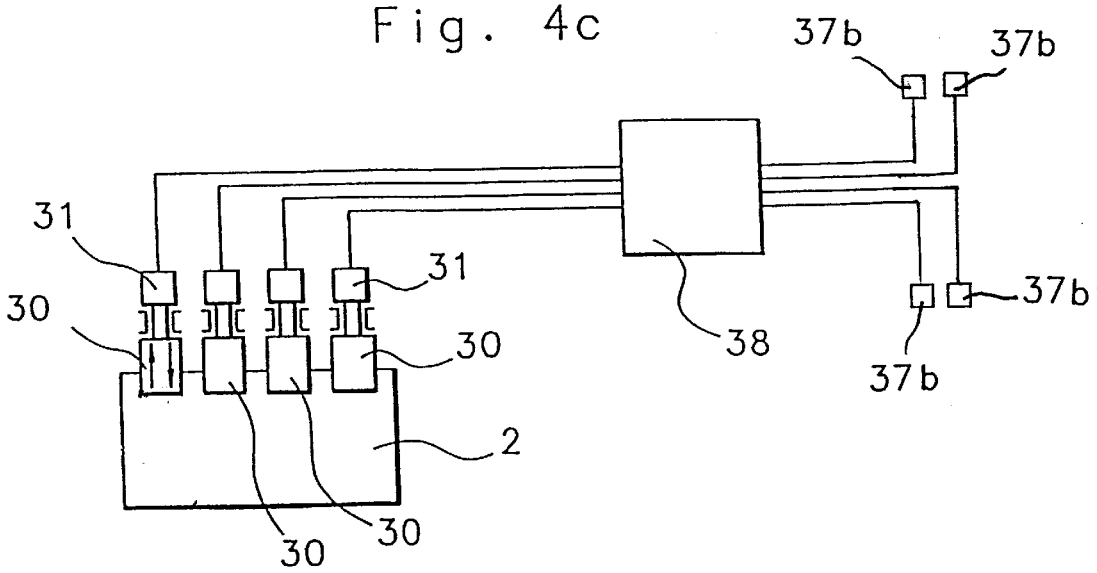
FIG. 4*c* is a sectional view taken along line IVc—IVc of FIG. 4*a*.

As shown in FIG. 4*a*, to the rearward face of each feed tray 7*a* a respective angle member 35 is affixed which is supported on a respective angle member 36 (affixed to the face 25*b* of the carrier beam 25) by a respective compression spring 27. Thus, by virtue of this arrangement each feed tray 7*a* of the feed tray array 7 is urged toward the feed roll 6 by its spring 27 in the direction of the arrow F and each feed tray 7*a* may pivot individually against the force of the spring 27 in the direction of the arrow G as urged by the force exerted on the feed tray 7*a* by the throughgoing fiber material. Between the movable angle member 35 and the fixed angle member 36 an inductive path sensor 37 is arranged. The path sensor 37 has a plunger armature 37*a* cooperating with a plunger coil 37*b* which is coupled to the electronic control and regulating device 38 as shown in FIG. 4*c*. Upon pivotal motion of the feed trays 7*a* and the resulting excursion of the plunger armature 37*a* of the respective inductive path sensor 37 in the direction of the arrows H, I, an electric pulse is generated which represents the excursions which are performed by the feed trays 7*a* in case the fiber thickness varies as the fibers pass through the feed gap defined by the feed roll 6 and the respective feed trays 7*a*. As shown in FIG. 4*b*, the carrier beam 25 with the feed trays 7*a*, on the one hand, and the feed roll 6, on the other hand, are mutually independently secured to the rigid side plates 39*a*, 39*b* of the machine. In this manner the carrier beam 25 with the feed trays 7*a* may be displaced locally relative to the feed roll 6 so that in case of different fiber material, or during maintenance work or the like the distance and thus the intake gap defined between the feed trays 7*a* and the feed roll 6 may be altered and adapted as required.

Figure 5:
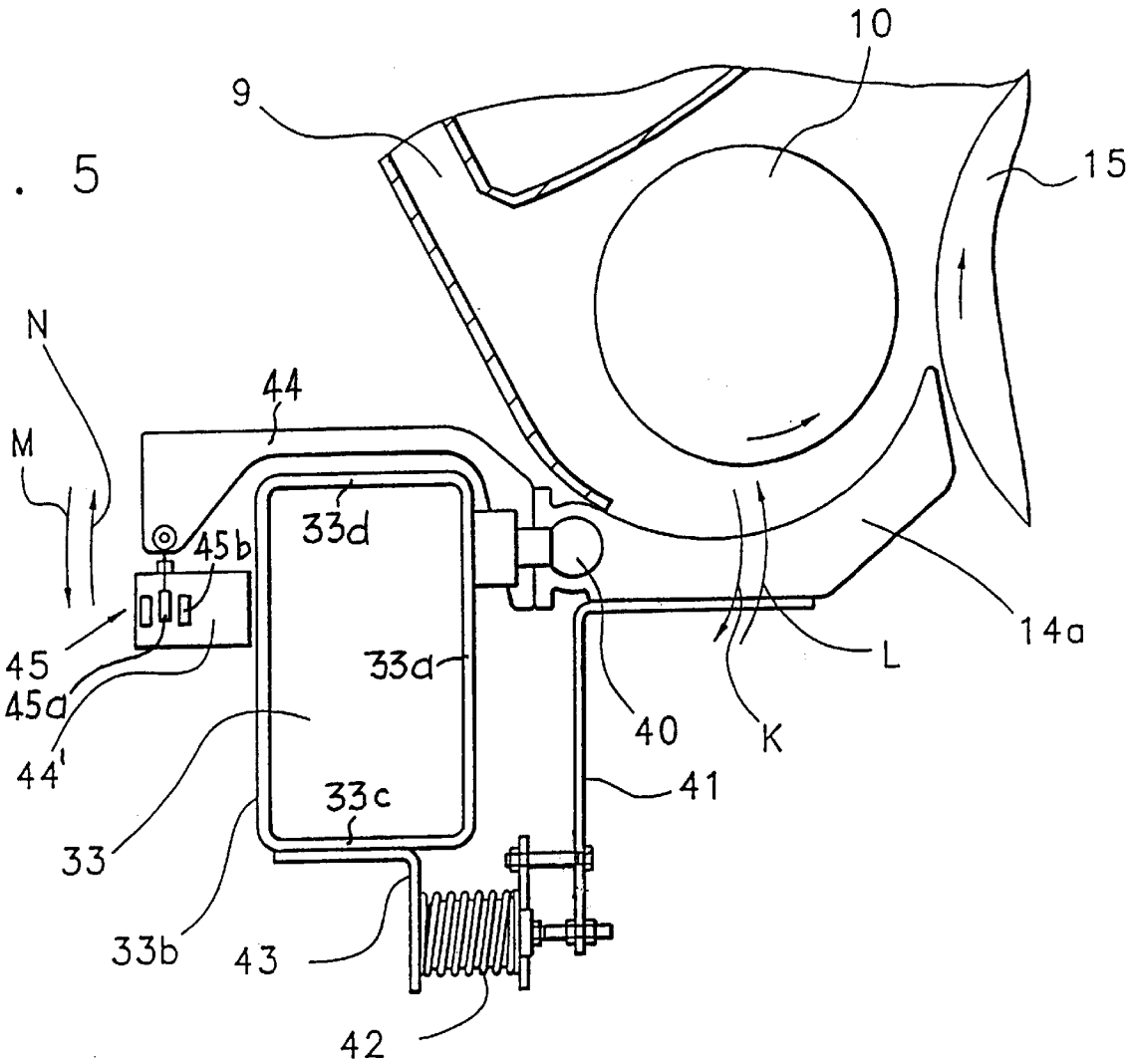
FIG. 5 is a sectional side elevational view of the lower part of the construction shown in FIG. 2, wherein the device according to the invention is located at the lower feed chute.

As shown in FIG. 5, in the region of the lower end of the side wall 9*a* of the feed chute 9 an approximately 5 m long carrier beam 33 is provided which extends over the entire width of the machine. This embodiment has sixteen individual feed trays 14*a* which form a feed tray array 14 and each has a length of 250 mm. Each feed tray 14*a* is an extruded aluminum component having a wear-resistant surface in the area where it is exposed to the fibers. The wear-resistant surface is provided by coating, by plating with high grade steel, or the like. The feed trays 14*a* are, at one of their ends, secured to the side wall 33*a* of the carrier beam 33 by means of respective rotary supports 40 to be rotatable in the direction of the arrows K, L. On their side oriented away from the fibers, each feed tray 14*a* is secured to one leg of respective angled members 41, whereas the other leg of the angled member 41 supports a respective spring 42 which presses against a respective angled member 43 secured to the bottom wall 33*c* of the carrier beam 33. To each rotary support 40 one end of a respective, generally U-shaped lever 44 is affixed which thus rotates as a unit with its associated rotary support 40 and which extends above the top wall 33*d* of the carrier beam 33. A respective support element 44' is affixed to the side wall 33*b* of the carrier beam 33. For each feed tray 14*a*, between the free end of the respective lever 44 and the support element 44' an inductive path sensor 45 is provided which is formed of a plunger armature 45*a* and a plunger coil 45*b* coupled to the electronic control and regulating device 38. In this manner, upon excursions of the feed trays 14*a* and a corresponding movement of the respective path sensor 45 in the direction of the arrows M, N, electric pulses are generated which represent the excursions of the respective feed trays 14*a* when the thickness of the fiber material passing through the intake gap changes.

Figure 6:
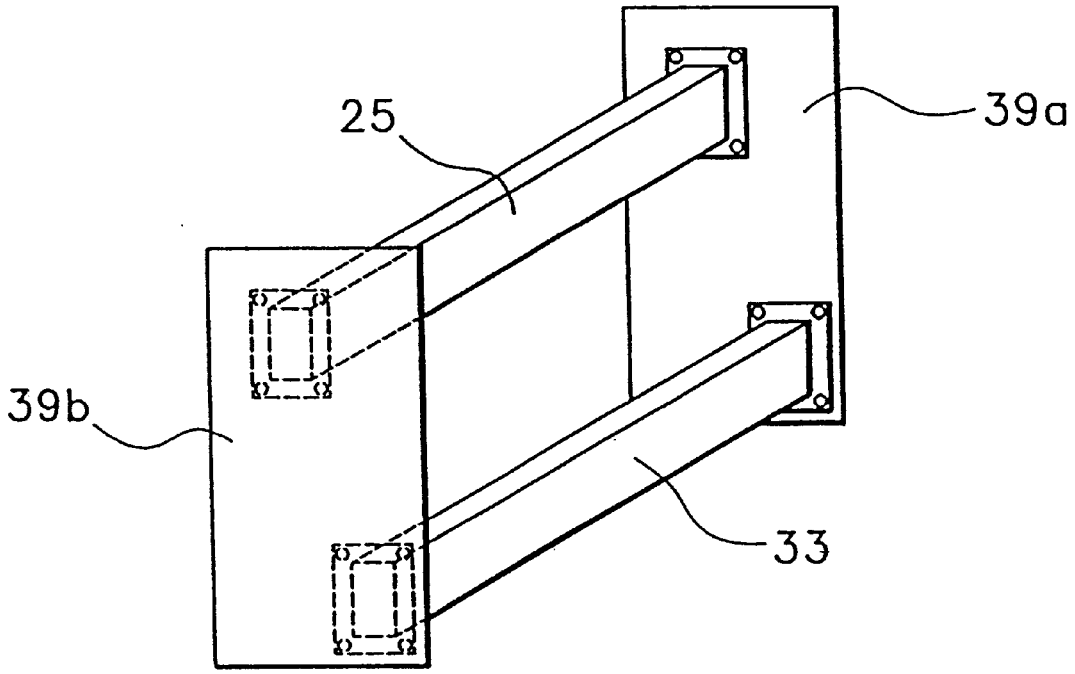
FIG. 6 is a perspective view illustrating the mounting of carrier elements to lateral machine frame walls.

FIG. 6 illustrates the securement of the ends of the carrier beams 25 and 33 to the inner faces of the machine side walls 39*a*, 39*b* by means of screws which may pass through slots of a mounting plate.

The above-described fiber tuft feeder combined with the roller card unit 1 includes the regulating system controlling the fiber lap profile for the roller card unit. Two systems are formed, namely the assembly formed of the feed roll 6 and the feed tray array 7 which close off the upper feed chute 2 and the assembly formed of the withdrawing roll 10 and the feed tray array 14 which closes off the lower end of the feed chute (lower chute) 9. In both systems a series of feed trays (7*a* and 14*a*) are used which cooperate with the feed roll 6 and the withdrawing roll 10, respectively. The feed tray widths and the zone division may be varied and adapted to the requirements.

Between the feed trays 7*a* and the feed roll 6 and the feed trays 14*a* and the withdrawing roll 10 in all zones the same pressing forces relative to the roll length units (for example, 10 cm) are preserved and deformations of a few millimeters are permitted.

All functional elements with the exception of the feed roll 6 and the withdrawing roll 10 are mounted on the carrier beam 25 or 33, while it is ensured that the force paths (represented by the carrier beams 25, 33, the rotary supports 26, 40, the series of feed trays 7*a*, 14*a*, the springs 27, 42) are very short and all elements are situated in the vicinity of the corners of the cross-sectionally rectangular carrier beams 25, 33.

It will be understood that the above description of the present invention is susceptible to various modifications, changes and adaptations, and the same are intended to be comprehended within the meaning and range of equivalents of the appended claims.

What is claimed is:

1. In a fiber processing machine for forming a fiber lap from fiber tufts, including a generally vertically oriented reserve chute having
reserve chute walls;
an inlet;
an outlet;
a horizontal depth;
a horizontal width extending perpendicularly to said depth;

a generally vertically oriented feed chute having an inlet adjoining said outlet of said reserve chute;

a fiber feeding assembly drawing fiber from said reserve chute and advancing fiber into said feed chute; the fiber feeding assembly including
a generally horizontally oriented feed roll having a rotary axis extending parallel to said width;
a feed tray array cooperating with the feed roll and being composed of a series of individual feed trays lined up along the feed roll and rotatable about an axis; each feed tray having a length extending parallel to the rotary axis and defining a nip with the feed roll;

measuring elements coupled to each feed tray for emitting signals representing an extent of excursion of the respective feed tray as the fiber material passes through the respective nip; and a control and regulating device connected to the measuring elements for receiving said signals;

the improvement comprising (a) movable wall elements arranged side-by-side parallel to said width and forming part of at least one of said reserve chute walls; each wall element having a wall element length extending parallel to said rotary axis; and (b) setting means connected to said wall elements for moving said wall elements in sections in a direction parallel to said depth for varying said depth; said setting means including setting members; each said wall element being connected to a separate one of said setting members.

2. The fiber processing machine as defined in claim 1, wherein said setting members are connected to said control and regulating device for varying said depth as a function of said signals.

3. The fiber processing machine as defined in claim 1, wherein said feed tray lengths are identical to respective said wall element lengths.

4. The fiber processing machine as defined in claim 1, wherein said reserve chute has a height; said wall elements extend throughout said height.

5. The fiber processing machine as defined in claim 1, wherein at least one of said wall elements is pivotally supported.

6. The fiber processing machine as defined in claim 1, wherein said setting members are pneumatic pressure cylinders.

7. A fiber processing machine for forming a fiber lap from fiber tufts, comprising (a) a generally vertically oriented reserve chute having an inlet and an outlet;

(b) a generally vertically oriented feed chute having
(1) an inlet adjoining said outlet of said reserve chute;
(2) feed chute walls;
(3) an outlet;
(4) a horizontal depth; and
(5) a horizontal width extending perpendicularly to said depth;

(c) a first fiber feeding assembly drawing fiber from said reserve chute and advancing fiber into said feed chute;

(d) a second fiber feeding assembly drawing fiber from said feed chute and discharging fiber through said outlet of said feed chute; the second fiber feeding assembly including
(1) a generally horizontally oriented withdrawing roll having a rotary axis extending parallel to said width; and
(2) a feed tray array cooperating with the withdrawing roll and being composed of a series of individual feed trays lined up along the withdrawing roll and rotatable about an axis; each feed tray having a length extending parallel to the rotary axis and defining a nip with the withdrawing roll;

(e) measuring elements coupled to each feed tray for emitting signals representing an extent of excursion of the respective feed tray as the fiber material passes through the respective nip;

(f) a control and regulating device connected to the measuring elements for receiving said signals;

(g) movable wall elements arranged side-by-side parallel to said width and forming part of at least one of said feed chute walls; each wall element having a wall element length extending parallel to said rotary axis; and (h) (b) setting means connected to said wall elements for moving said wall elements in sections in a direction parallel to said depth for varying said depth; said setting means including setting members; each said wall element being connected to a separate one of said setting members.

8. The fiber processing machine as defined in claim 7, wherein at least one of said wall elements is pivotally supported.

9. The fiber processing machine as defined in claim 7, further comprising rotary supports attaching said wall elements to one of said feed chute walls.

10. In a fiber processing machine for forming a fiber lap from fiber tufts, including a generally vertically oriented reserve chute having
reserve chute walls;
an inlet;
an outlet;
a horizontal depth;
a horizontal width extending perpendicularly to said depth;
means for introducing fiber tufts with an air stream in said reserve chute at an upper part thereof;
air outlet openings provided in a zone of said reserve chute at an upper part thereof;
means operatively coupled to said zone for drawing air out of said reserve chute through said air outlet openings;

a generally vertically oriented feed chute having an inlet adjoining said outlet of said reserve chute;

a fiber feeding assembly drawing fiber from said reserve chute and advancing fiber into said feed chute; the fiber feeding assembly including
a generally horizontally oriented feed roll having a rotary axis extending parallel to said width;

a feed tray array cooperating with the feed roll and being composed of a series of individual feed trays lined up along the feed roll and rotatable about an axis; each feed tray having a length extending parallel to the rotary axis and defining a nip with the feed roll;

measuring elements coupled to each feed tray for emitting signals representing an extent of excursion of the respective feed tray as the fiber material passes through the respective nip; and a control and regulating device connected to the measuring elements for receiving said signals;

the improvement comprising (a) movable wall elements arranged side-by-side parallel to said width and forming part of at least one of said reserve chute walls; said movable wall elements being situated at all times below said zone of said reserve chute; each wall element having a wall element length extending parallel to said rotary axis; and (b) setting means connected to said wall elements for moving said wall elements in sections in a direction parallel to said depth for varying said depth; said setting means including setting members; each said wall element being connected to a separate one of said setting members.

* * * * *